United States Patent [19]

Terzian

[11] 4,263,742

[45] Apr. 28, 1981

[54] ANIMATED DOLL

[75] Inventor: Rouben T. Terzian, Chicago, Ill.

[73] Assignee: Marvin Glass & Associates, Chicago, Ill.

[21] Appl. No.: 10,937

[22] Filed: Feb. 9, 1979

[51] Int. Cl.[3] ..... A63H 11/00; A63H 3/36

[52] U.S. Cl. ..... 46/135 R; 46/171; 46/119

[58] Field of Search ..... 46/135, 44, 118, 171, 46/119, 115, 116, 120

[56] References Cited

U.S. PATENT DOCUMENTS

| | | | |
|---|---|---|---|
| 993,282 | 5/1911 | Tower | 46/135 R |
| 2,620,593 | 12/1952 | Rockwood | 46/135 R |
| 3,099,894 | 8/1963 | Carroll | 46/135 R |
| 3,236,006 | 2/1966 | Carroll | 46/135 R |
| 3,341,723 | 9/1967 | Tourtellot | 318/558 X |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

An animated doll includes a hollow head and a hollow body with the head having a face on the front defining a mouth opening. The mouth opening is elongated in one direction and includes a pair of lips defined along opposite longitudinal edges. A movable tongue extends downwardly of the mouth opening between the lips and includes an outer end portion which is formed to cover over an area of one of the lips. An operator is provided for moving the tongue along the edges of the mouth between the lips and rotating the tongue about an axis extending outwardly of the mouth whereby the outer end portion of the tongue appears to smack the lips.

12 Claims, 3 Drawing Figures

10
12
14
16
18
20
22
24
26
28
30
32
34
38
40
42
44
44a
46
48
48a
48b
48c
49
50
52
52a
54
54a
56
56a
56b
58
58a
58b
60
62
64
66
68
70
72
74
74a
75
"A"
"B"
"C"

ANIMATED DOLL

BACKGROUND OF THE INVENTION

1. Field of the Invention

The present invention relates to animated dolls and more particularly relates to an animated doll having a tongue projecting out of the doll's mouth which is operable to move in a manner resembling the smacking of lips. 2. Description of the Prior Art A wide variety of animated dolls have been developed over the years with animated actions becoming ever more complex in nature and more and more, very closely resembling the actions of human beings. In U.S. Pat. No. 2,631,407 a hollow toy figure or doll is provided with a pop-out tongue. In U.S. Pat. No. 3,153,881 an animated doll is illustrated having movable lips and a tongue which can be manipulated to simulate different facial expressions such as sadness, smiling or laughing. U.S. Pat. No. 3,959,919 discloses an animated doll having a movable mouth which is operable to simulate movements resembling that of nursing action for liquid intake and action resembling the excretion of liquid. Another animated doll is shown in U.S. Pat. No. 3,996,695 which discloses a doll with a movable head which appears to sneeze.

SUMMARY OF THE INVENTION

The foregoing and other objects and advantages of the present invention are accomplished in an illustrated embodiment comprising an animated doll having a hollow head and body with a face of the head defining a mouth opening elongated in one direction and including a pair of lips defined along opposite longitudinal edges. A movable tongue projects outwardly of the mouth between the lips and includes an outer end portion which is formed to cover an area of one of the lips. An operator is provided for moving the tongue along the edges of the mouth between the lips while rotating the tongue about an outwardly extending axis whereby the outer end portion of the tongue appears to smack the lips.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figures 1, 2, 3:
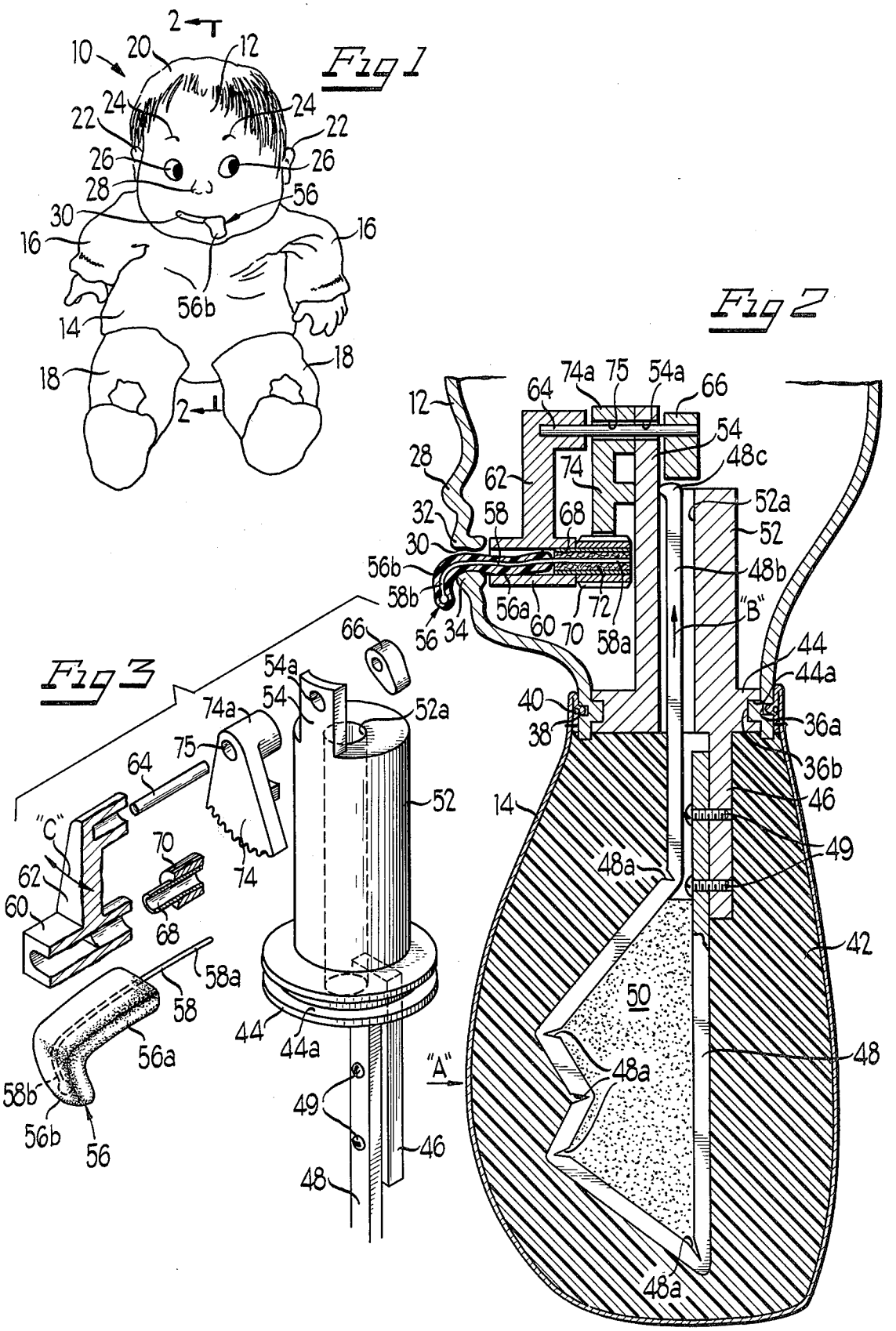
FIG. 1 is a front view of an animated doll constructed in accordance with the features of the present invention.
FIG. 2 is a longitudinal sectional view of the doll taken substantially along lines 2—2 of FIG. 1.
FIG. 3 is an exploded, enlarged, perspective view with portions broken away for clarity illustrating the operating mechanism of the doll for moving the tongue in a lip smacking motion.

Referring now more particularly to the drawings, in FIG. 1 is illustrated a new and improved animated doll constructed in accordance with the features of the present invention and referred to generally by the reference numeral 10. The doll is fashioned and shaped to resemble a young child or baby and includes a hollow head 12, a hollow body 14, and pairs of legs and arms 16 and 18. The head is formed of molded flexible plastic material and is decorated to resemble a young child's face including hair 20, ears 22, eyebrows 24, eyes 26, a nose

28, and an elongated mouth opening 30 extending laterally between opposite sides or cheeks of the face. An upper lip 32 and a lower lip 34 are provided along the opposite longitudinal edges of the mouth.

The head 12 terminates in a downwardly depending neck portion 36 of circular cross-section having an annular groove 36a formed in the outer surface thereof adapted to receive a folded over flange portion 38 on the upper end of the hollow body 14. The flange is secured within the groove by a snap ring 40 as illustrated. The body 14 is hollow and is formed of thin flexible plastic material which is molded to shape and which is filled with a resilient compressible foam 42 which is readily compressed inwardly when a force is applied to the stomach or mid portion of the body as indicated by the arrow "A" in FIG. 2.

The neck portion 36 of the doll's head 12 includes an inwardly extending annular rib **36*b* which is engaged or seated in a groove 44a formed around the periphery of a generally cylindrical circular operator base structure 44 preferably formed of integrally molded, relatively rigid, plastic material. The circular base provides backing for the rotative interconnection between the doll's head and body and is formed with an integral downwardly extending tang 46 which projects into a recess in the foam 42 contained in the body. The tang provides support for an elongated strip 48 of relatively stiff, strong, but flexible plastic material attached thereto by cap screws 49**.

The strip 48 has a generally rectangular transverse cross-section and is formed with longitudinally spaced apart V-shaped notches **48*a* which facilitate bending of a forward portion of the strip into a shape as shown in FIG. 2, resembling the letter "W". This portion of the strip projects forwardly of the tang 46 towards the front or stomach wall of the doll's hollow body 14. A fill of compressible, flexible foam material 50 is provided between inside surface portions of the "W" shaped portion of the strip 48 and the depending portion as shown. This foam material 50 tends to return the "W" shaped portion to its original shape after each depression. Moreover, inward pressure on the abdomen of the doll's body 14 in the direction of the arrow "A" deflects the strip elements of the "W" shaped portion inwardly causing the strip to bend at the V-shaped notches or crevices 48*a* and results in the upward movement of an actuator portion 48*b* in the direction of the arrow "B" as illustrated. The upstanding actuator portion 48*b* extends upwardly through and is guided by the wall surfaces of an elongated hollow bore 52*a* formed in a generally cylindrical shaped element 52 having a tang 54** projecting upwardly from the upper surface on the forward side.

In accordance with the present invention, the doll 10 includes a tongue 56 formed of soft, compressible, flexible plastic material such as vinyl, shaped with an elongated, main body portion **56*a* mounted to extend outwardly through the mouth opening 30 between the upper and lower lips 32 and 34. The tongue is strengthened by means of a centrally disposed core 58 formed of relatively stiff but flexible plastic material such as "Nylon" or the like. The core includes an elongated main body portion 58*a* which reinforces the main body portion 56*a* of the tongue. The tongue includes an angularly disposed, outer end portion or tip 56*b* which is reinforced by an outer portion 58*b*** of the core which provides additional stiffness for the tip of the tongue.

When the tongue and core portions 56*a* and 58*a* are rotated about an outwardly extending axis between the lips 32 and 34, the outer end portion or tip of the tongue 56*b* rotates up and down in front of and covers over portions of the lips in a lip smacking motion.

Preferably, the material of the tongue itself is integrally molded over the central core material as illustrated in FIG. 3, and rotation of the inner end portion of the core 58*a* will result in a following rotation of the main body portion 56*a* of the tongue as well as the tip portion 56*b* which may lag or lead somewhat owing to the inherent flexibility and deformability of the tongue material. This arrangement and construction provides a highly realistic lip smacking motion.

In accordance with the invention, a portion of the main body 56*a* of the tongue is supported for rotation within a hollow, tubular sleeve 60 which is integrally molded on the lower end of a swing arm 62 connected at its upper end to a support axle 64. The axle 64 is journaled for rotation in an opening 54*a* provided in the upstanding support tang 54 on the base 52. A tear drop shaped cam 66 is secured on an inner end portion of the axle 64 to be engaged by an enlarged, upper end portion 48*c* on the activator stem 48*b*. Upward travel of the actuator stem as illustrated by the arrow "B" engages the cam causing the axle 64 to rotate in either direction and thereby swing the arm 62 to move the tongue back and forth from side to side in the mouth opening 30.

Inward pressure on the abdomen of the doll's body 14, as indicated by the arrow "A", causes the operator stem 48*b* to move upwardly to engage and rotate the cam 66 which in turn causes the tongue support sleeve 60 on the lower end of the swing arm 62 to swing back and forth on an arcuate path to carry the tongue from side to side in the mouth opening 30.

In order to rotate the tip 56*b* of the tongue and thereby provide a realistic lip smacking appearance, a hollow sleeve 68 with a gear 70 provided at the inner end is secured to an inner end portion of the tongue core 58*a* by adhesive or cement 72. The forward end portion of the sleeve 68 is journaled in an inner end portion of the swing arm 60 and rotation of the gear 70 causes the tongue core portion 58*a* and main body portion 56*a* of the tongue to rotate within the supporting sleeve. This rotates the tip 56*b* of the tongue to smack the lips.

The gear 70 is driven to rotate when the swing arm 62 oscilates back and forth (arrow "C" of FIG. 3) by means of teeth on an arcuate sector gear 74 which is mounted on the forwardly facing surface of the cylindrical base 52. The sector gear includes a boss-like cylindrical portion 74*a* at the upper end having a hollow bore 75 aligned with the bore 54*a* in the tang to journal the axle 64. It will thus be seen, when the abdomen of the doll is pushed inwardly as indicated by the arrow "A", upward travel of the operator stem 48*b* results, as indicated by the arrow "B". This causes the cam 66 to rotate the shaft 64 in either direction resulting in a swinging movement of the arm 62 (arrow "C"). The swing arm sleeve 60 at the lower end of the swing arm carries the tongue 56 from side to side in the mouth opening 30 and at the same time, oscillation of the swing arm 62 causes the gear 70 to rotate the sleeve 68 which is connected to the rearward end portion of the tongue core 58*a* and thus, the outer end or tip portion 56*b* of the tongue 56 appears to smack the lips by rotation as the tongue moves laterally back and forth in the mouth opening 30.

The animated doll 10 provides a realistic lip smacking type appearance when the abdomen of the doll's body 14 is pushed inwardly. The outer end portion or tip 56*b* of the flexible tongue 56 is angularly deformed to cover portions of the lips 32 and 34 when the tongue is rotated. The special construction of the tongue and its core 58 provide a highly realistic lip smacking tongue action for the doll.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated doll comprising:

a head having a base with a mouth opening, said opening elongated in one direction and including lips defined along opposite longitudinal edges;

a movable tongue extending outwardly of said mouth opening between said lips and including an outer end portion formed to cover an area of a lip; and means for moving said tongue along said edges between said lips, said moving means including means for rotating said tongue about an axis extending outwardly of said mouth as said tongue is moved along said edges.

2. The animated doll of claim 1 wherein said tongue includes an elongated core of relatively stiff flexible material and a body of deformable material around said core, shaped to appear as a tongue.

3. The animated doll of claim 2 wherein said core includes a main portion extending along said axis and an outer end portion angularly disposed thereto providing support for said outer end portion of said tongue.

4. The animated doll of claim 1 wherein said outer end portion of said tongue is angularly disposed with respect to a main portion thereof extending along said axis of rotation.

5. The animated doll of claim 3 wherein said rotating means includes rotating drive means connected with an inner end portion of said tongue for rotating the tongue around said axis and bearing means for supporting said drive means for rotation.

6. The animated doll of claim 5 wherein said bearing means supports said inner end portion of said tongue for rotation on said axis.

7. The animated doll of claim 6 wherein said bearing means is mounted on a swinging arm for movement back and forth across said mouth opening behind said face.

8. The animated doll of claim 7 including a fixed drive element engaging said drive means to rotate said tongue on said axis when said arm is swung back and forth.

9. The animated doll of claim 7 or 8 wherein said doll includes a body and means in said body for swinging said arm back and forth.

10. The animated doll of claim 8 wherein said drive means includes a gear and said fixed drive element includes a gear segment drivindly engaging said gear to rotate the same when said arm is swung back and forth.

11. The animated doll of claim 9 wherein said arm is mounted for swinging movement on an axle spaced above said axis of said tongue.

12. The animated doll of claim 11 wherein said means in said body is interconnected to rotate said axle for swinging said arm.

* * * * *